US009255697B2

(12) United States Patent
Acampora et al.

(10) Patent No.: US 9,255,697 B2
(45) Date of Patent: Feb. 9, 2016

(54) LIGHT FIXTURE HOUSING AND MOUNTING THEREFOR

(71) Applicant: ABL IP Holding LLC, Conyers, GA (US)

(72) Inventors: Kenneth J. Acampora, Northridge, CA (US); Terrence Keith Bridges, Round Rock, TX (US)

(73) Assignee: ABL IP Holding LLC, Decatur, GA (US)

( * ) Notice: Subject to any disclaimer, the term of this patent is extended or adjusted under 35 U.S.C. 154(b) by 0 days.

(21) Appl. No.: 14/281,091

(22) Filed: May 19, 2014

(65) Prior Publication Data

US 2014/0254178 A1 Sep. 11, 2014

Related U.S. Application Data

(62) Division of application No. 13/224,646, filed on Sep. 2, 2011, now Pat. No. 8,770,804.

(51) Int. Cl.

| | |
|---|---|
| ***F21V 15/01*** | (2006.01) |
| ***F21V 33/00*** | (2006.01) |
| ***F21V 21/30*** | (2006.01) |
| ***F21V 23/04*** | (2006.01) |

(52) U.S. Cl.

CPC ..... *F21V 15/01* (2013.01); *F21V 21/30* (2013.01); *F21V 23/0464* (2013.01); *F21V 33/006* (2013.01)

(58) Field of Classification Search

CPC ..... F21V 15/01; F21V 33/006; F21V 21/30; F21V 23/0465

See application file for complete search history.

(56) References Cited

U.S. PATENT DOCUMENTS

| | | | | |
|---|---|---|---|---|
| 3,505,515 | A | 4/1970 | Adra | |
| 3,543,016 | A | 11/1970 | Jones | |
| 4,480,809 | A | 11/1984 | Healey | |
| 4,907,139 | A * | 3/1990 | Quiogue | 362/153 |
| 5,377,076 | A * | 12/1994 | Wen | 361/679.01 |
| 5,526,526 | A * | 6/1996 | Clark et al. | 455/90.3 |
| 6,161,948 | A | 12/2000 | Hagen | |
| 6,428,197 | B1 | 8/2002 | Downing | |
| 7,470,895 | B1 * | 12/2008 | Cramer et al. | 250/239 |

(Continued)

OTHER PUBLICATIONS

Notice of Allowance for U.S. Appl. No. 13/224,646, Mar. 10, 2014, 10 pages.

Large scale floodlights, BEGA-US, Sep. 2009.

(Continued)

*Primary Examiner* — Thomas M Sember

(74) *Attorney, Agent, or Firm* — Kilpatrick Townsend & Stockton, LLP

(57) ABSTRACT

An architectural light fixture with a mounting includes a rigid yoke with opposed mounts aligned with external cavities located on a housing. The cavities have conical inner surfaces and bottoms with fastener engagements. Yoke pins include conical outer surfaces to operate as yoke locks. Fastener associated with the yoke pins engage to draw the yoke locks into interfering fit with the truncated conical inner surface of the mounting cavity. The light fixture housing has a port with a plug of porous water repellant material. A cover is employed to protect the plug. The light fixture housing also has a flat mounting surface with a wire access hole. The fixture includes a cover to enclose a photocell biased toward the mounting surface and retains an O-ring against the fixture housing.

20 Claims, 2 Drawing Sheets

(56) References Cited

U.S. PATENT DOCUMENTS

2010/0254147 A1 10/2010 Tsao
2013/0058106 A1 3/2013 Acampora et al.

OTHER PUBLICATIONS

DFS2 Series DecoFlood Small Round—39-100 W HID—Philips WideLite, 2011 Bulletin No. WLSP0329A0211, pp. 1-8 (2011) (Believed to be available at least as early as Sep. 1, 2010).

DFS3 Series DecoFlood Medium Round—39-210 W HID—Philips WideLite, 2011—Bulletin No. WLSP0330A0211, pp. 1-12 (2011) (Believed to be available at least as early as Sep. 1, 2010).

Kim Lighting AXF20 Axial Flood™—Integral Ballast—rev. Oct. 1, 2008—5646008275, pp. 1-10.

Kim Lighting AXF30 Axial Flood™—Integral Ballast—rev. Oct. 1, 2008—5646108275, pp. 1-9.

DPN Series Part Night, Electronic Locking Type Photocontrol, Sheet# DTL-DPN-D (Believed to be available at least as early as Sep. 1, 2010).

Gore, Protective Vents, Screw-in Vents brochure, PTV-031-R7-SCH-US-AUG11, Aug. 2011, 4 pgs. (Believed to be available at least as early as Sep. 1, 2010).

* cited by examiner

LIGHT FIXTURE HOUSING AND MOUNTING THEREFOR

RELATED APPLICATIONS

This application is a divisional of U.S. Ser. No. 13/224,646 filed Sep. 2, 2011 entitled "LIGHT FIXTURE HOUSING AND MOUNTING THEREFOR," now allowed, the entire contents of which are hereby incorporated by reference.

BACKGROUND OF THE INVENTION

The field of the present invention is architectural fixtures and mountings for lighting.

Typical yoke mounted fixtures utilize external opposed parallel surfaces on a fixture housing. These surfaces are either smooth or include radial serrations. The yoke associated therewith has matching inner surfaces alignable with the fixture housing surfaces. Concentrically arranged fasteners compress the surfaces together to create a friction joint that will prevent the yoke from slipping and losing the fixture aim. Smooth surfaces can be unreliable and allow slippage. This can be of concern, particularly for architectural lighting fixtures which may be difficult to access once in place. With serrated surfaces, slipping is unlikely. However, adjustability is limited by the pitch of the serrations.

Concentrically arranged fasteners acting as trunnions are also problematic with larger fixtures. If studs are employed in the housing, the yoke must be bent for assembly or disassembly. Bolts through the yoke can make assembly difficult and provide inadequate pivot members.

Architectural light fixtures have experienced additional issues. The housings typically have cavities which heat and cool with cycling of the light. Air pressure can vary significantly within the housings under such cycling. This can ultimately result in seal damage, leakage and lens distortion or failure.

An additional issue with exterior light housings is the employment of photocells to control the light. For lower wattage fixtures with large housings, internal temperatures do not greatly vary. In such fixtures, button-type photocells are typically employed. These photocells have temperature limitations and are impractical for higher wattage lights. For fixtures where the temperature will vary substantially, external photocell devices are typically employed. These photocells know as "twist lock" type photocells require that they remain in a vertical position to prevent water intrusion and subsequent failures. The external positioning of the cells also detracts from the architectural aesthetics.

SUMMARY OF THE INVENTION

The present invention is directed to architectural light fixtures employing light fixture housings.

A first separate aspect of the present invention is such a light fixture with a mounting. The mounting includes a rigid yoke having opposed mounts which are alignable with external opposed cavities located on the fixture housing. At least one of the cavities and one of the mounts cooperate to provide a locking feature. This feature includes a mounting cavity having a truncated conical inner surface and a bottom having a fastener engagement. A yoke pin extends through a bore in the mount of the rigid yoke. The pin includes a truncated conical outer surface to operate as a yoke lock. The yoke pin further includes a positioning surface to engage the yoke mount such that the conical outer surface of the yoke pin can be drawn into interfering fit with the truncated conical inner surface of the mounting cavity in the housing. The yoke pin operating as a lock includes a retainer to prevent rotation within the yoke mount. A fastener associated with the yoke pin can engage the fastener engagement to draw the yoke lock into interfering fit with the truncated conical inner surface of the mounting cavity.

The foregoing separate aspect of the present invention may further include a symmetrically positioned central mount having an inner truncated conical surface facing away from the yoke mounts through which a fastener extends to engage a supporting base.

A second separate aspect of the present invention includes a light fixture with a housing having a port there through with a plug of porous water repellant material known commercially as a gore vent. Such a plug allows the flow of air to and from the internal cavity of the fixture to maintain a neutral pressure. A cover with an exit to atmosphere is employed to protect the plug and shed water away from the plug regardless of the fixture orientation.

A third separate aspect of the present invention is a light fixture with a housing including a flat mounting surface with a wire access hole there through. A photocell is positioned on the mounting surface and the fixture includes a protective hard cover to enclose the photocell. The photocell is biased toward the mounting surface and includes a sealing surface facing the mounting surface to retain an O-ring between the photocell and the fixture housing about the wire access hole. The cover includes an aperture to enable operation of the photocell. The aperture is aligned with the light receptor of the photocell. The aperture may be open with the photocell being separately sealed.

In a further aspect of the present invention, any of the foregoing aspects are contemplated to the used in combination to better advantage.

Thus, it is an object of the present invention to provide an improved light fixture housing and mounting. Other and further objects and advantages will appear hereinafter.

DETAILED DESCRIPTION OF THE PREFERRED EMBODIMENTS

Figure 1:
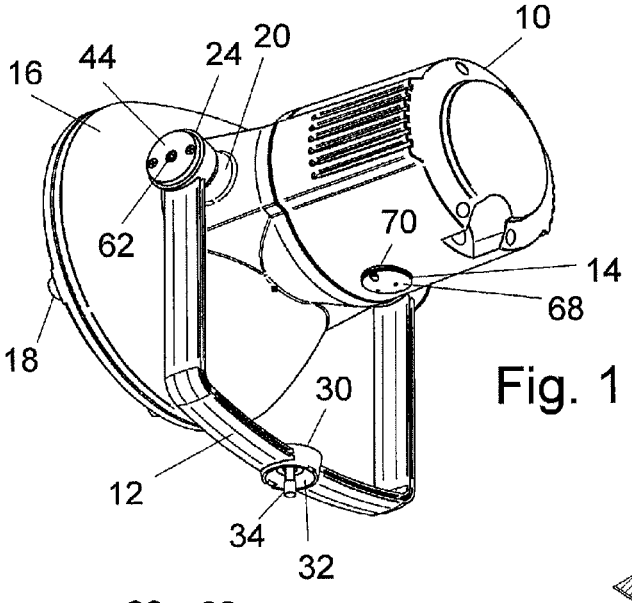
FIG. 1 is a perspective view of an assembled light fixture and mounting.
Figure 4:
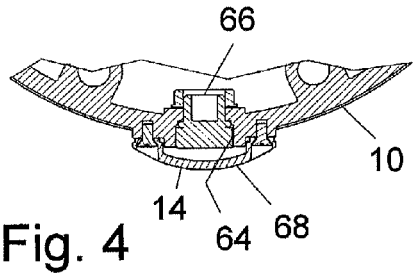
FIG. 4 is a cross-sectional front view in detail of a porous plug in the housing of FIG. 1.

Turning in detail to the figures, a light fixture is illustrated in FIG. 1. The light fixture includes a housing 10 having a mounting 12 and a pressure management assembly 14. The light fixture housing 10 includes an internal cavity (not shown), a bell shaped reflector portion 16 and a lens assembly 18. Bosses 20 are located on the light fixture housing 10 in opposed positions. The mounting 12 aligns with these bosses 20.

Figure 2:
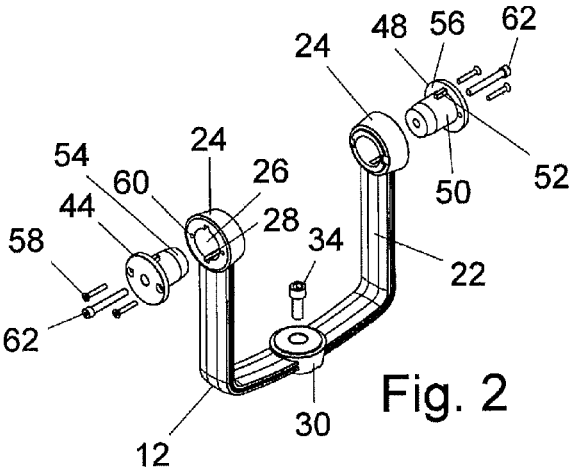
FIG. 2 is an exploded assembly perspective of the mounting of FIG. 1.
Figure 5:
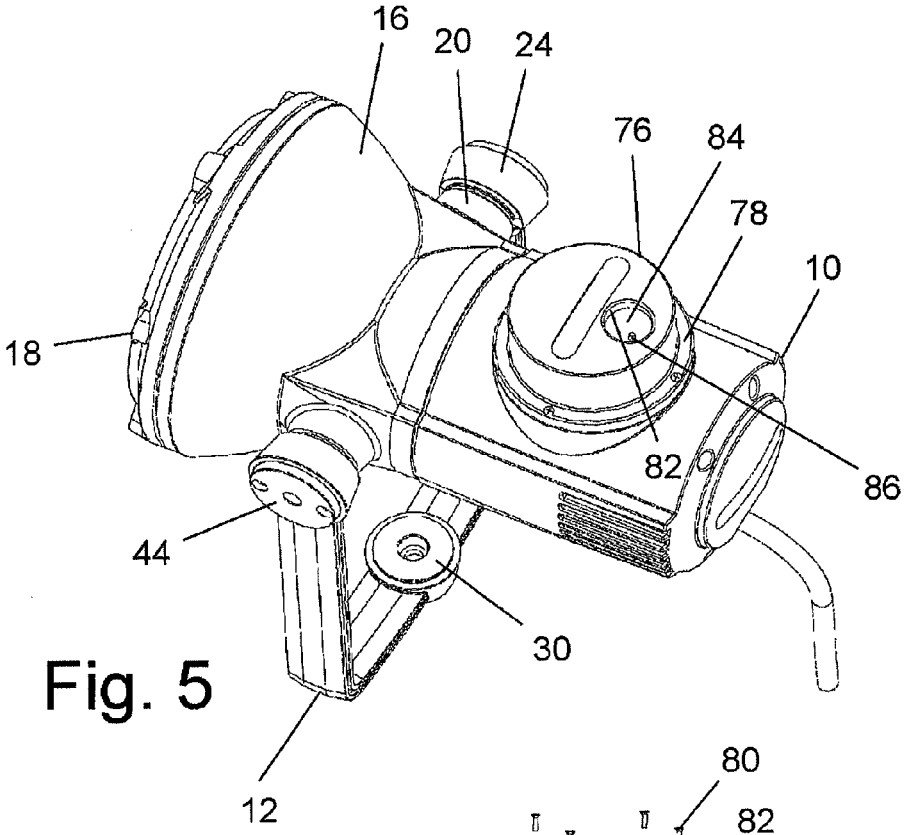
FIG. 5 is a perspective view of the fixture housing and mount of FIG. 1 showing a photocell mounting.
Figure 6:
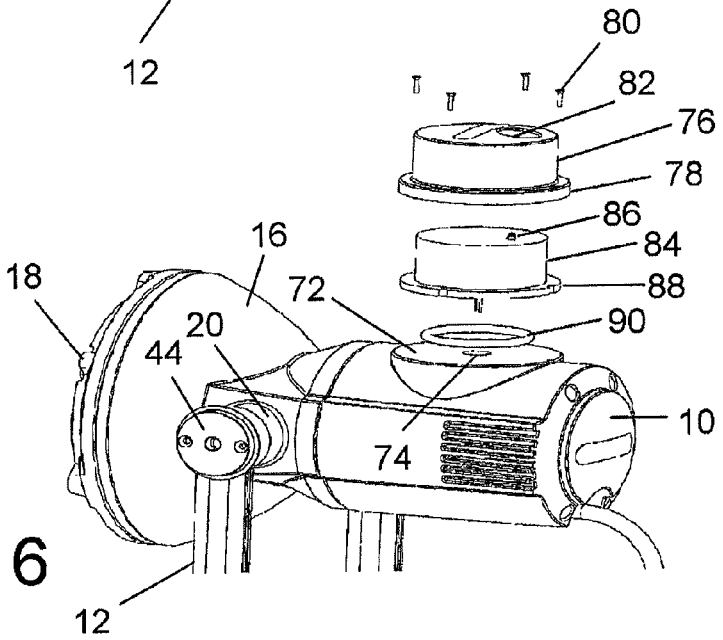
FIG. 6 is an exploded perspective view of the photocell associated with the fixture housing.

FIG. 2 is an exploded assembly view of the mounting 12. The mounting 12 includes a rigid yoke 22 having opposed mounts 24. The mounts 24 each have a cylindrical bore 26 there through with key ways 28 cut in the surface of each cylindrical bore 26. The cylindrical bores 26 are coaxial and align with the bosses 20 of the fixture housing 10 when positioned thereabout. The rigid yoke 22 further includes a central mount 30 which is symmetrically positioned. The central mount 30 has an inner truncated conical surface 32 facing away from the opposed mounts 24 with a fastener 34. The central mount 30 is for mounting with a truncated outer conical surface of a base support (not shown).

Figure 3:
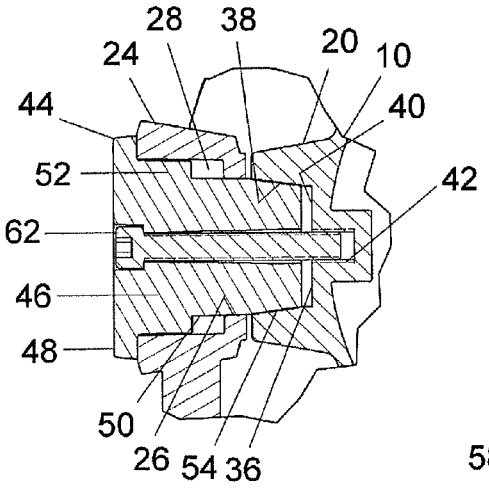
FIG. 3 is a cross-sectional detail taken through a center line of one mount assembled with the fixture housing of FIG. 1.

Looking to FIG. 3, the bosses 20 are shown to have external and opposed mounting cavities 36, both sides being identical in the mountings. Each opposed mounting cavity 36 includes a truncated conical inner surface 38 with a bottom 40. A threaded hole 42 in the bottom 40 provides a fastener engagement.

Yoke pins 44 are positionable in the cylindrical bores 26 of the rigid yoke 22. One or both of these pins 44 operate as a yoke lock. The other may provide a simple trunnion pivot. In the preferred embodiment, the yoke pins 44 each are configured to be yoke locks. The yoke pins 44 extend through the cylindrical bores 26 to the opposed mounting cavities 36 of the light fixture housing 10.

Each yoke pin 44 includes a body 46 having a circular flange 48 at one end. The central portion 50 of the body 46 is cylindrical. This portion 50 fits closely within the cylindrical bore 26 of the opposed mount 24. The central portion 50 includes two keys 52 to mate with the key ways 28 within the cylindrical bore 26. Each yoke pin 44 further includes a truncated conical outer surface 54 on the end of the yoke pin 44 opposite to the circular flange 48. The truncated conical outer surface 54 has a conical angle to mate with the truncated conical inner surface 38. Through compression of these two surfaces 38, 54, longitudinal compression can produce an interference fit to lock the surfaces together. The circular flange 48 on the yoke pin 44 includes a positioning surface 56 to be brought against one side of the mount 24 for proper longitudinal placement of the pin 44. Fasteners 58 through the circular flange 48 extend to threaded holes 60 in the mount 24 to retain the yoke pin 44 in position within the mount 24. A threaded fastener 62 extends concentrically through the yoke pin 44 to engage the fastener engagement 42 in the bottom 40 of the mounting cavity 36.

In operation, the opposed mounts 24 of the rigid yoke 22 are positioned over the mounting cavities 36. The yoke pins 44 are extended through the cylindrical bores 26 to engage the mounting cavities 36. They are retained in appropriate position by the positioning surfaces 56 held in place by the threaded fasteners 58. The yoke pins 44 are then in engagement with the conical inner surfaces 38 of the opposed mounting cavities 36; and the fixture housing 10 can pivot thereabout to aim the fixture.

The concentrically arranged fasteners 62 are then engaged and tightened with the fastener engagements 42 to draw the inner and outer conical surfaces 38, 54 into locking engagement. The truncated conical outer surface 54 is of sufficient diameter at its truncated end so that it will not extend inwardly to the bottom 40 of the mounting cavity 36 before coming into interference fit with the inner surfaces 38. Further, the yoke pins 44 are retained relative to the opposed mounts 24 such that the fixture housing 10 and the mounts 24 of the rigid yoke 22 are spaced apart with the truncated conical inner surfaces 38 and the truncated conical outer surfaces 54 engaged in interference fit. These relationships ensure that tightening of the concentrically mounted fastener 62 will bring the inner and outer conical surfaces 38, 54 into interference fit.

The light fixture housing 10 further includes a port 64 on its underside. A plug 66 doses the port 64. This plug 66 is of porous water repellent material. Such plugs 66 are commercially available as gore vents. By being both porous and water repellent, the plug allows air but not moisture there through. As a result, the plug can relieve pressure within with central cavity of the light fixture housing 10 while preventing moisture intrusion as the fixture breathes. An external cover 68 is positioned over the port 64 and displaced from the plug 66. This external cover 68 has one or more holes 70 there through to provide an exit to atmosphere for air passing through the plug 66.

The light fixture housing 10 further includes on its upper surface an integral flat mounting surface 72. The mounting surface 72 includes a small hole 74 to provide wire access from within the central cavity of the light fixture housing 10. Threaded holes (not shown) are positioned about the mounting surface 72. A cover 76 including a cavity therein has a mounting flange 78 to mate with the mounting surface 72 and to be held in place by fasteners 80 engaging the threaded holes thereon. An open aperture 82 on the upper surface of the cover 76 provides light access into the interior of the cover 76.

A sealed photocell 84 is positioned within the cover 76 such that the light receptor 86 of the photocell 84 is aligned with the aperture 82. The photocell 84 has a flange 88 fitting under the mounting flange 78 of the cover 76. This assembly biases the photocell 84 downwardly toward the mounting surface 72 when the cover 76 is fastened to the light fixture housing 10. The bottom of the sealed photocell 84 has a sealed surface facing toward the mounting surface 72. An O-ring 90 positioned between the photocell 84 and the mounting surface 72 is compressed to seal the hole 74. An O-ring seat or seats may be included on one or both of the surfaces to position or retain the O-ring. With this assembly, a controlling photocell 84 is able to be employed with the housing 10 externally to the central cavity of the housing 10 with the light receptor 86 open to the environment; and yet, the assembly forms an integral part of the lamp assembly with appropriate environmental sealing for the main cavity of the housing 10.

Thus, an improved architectural light fixture and mounting is disclosed. While embodiments and applications of this invention have been shown and described, it would be apparent to those skilled in the art that many more modifications are possible without departing from the inventive concepts herein. The invention, therefore, is not to be restricted except in the spirit of the appended claims.

The invention claimed is:

1. A light fixture comprising:

a fixture housing comprising a main cavity and an exterior, the exterior comprising a mounting surface with a wire access hole there through into the main cavity;

a cover fastened to the mounting surface and comprising an aperture;

a sealed photocell comprising a sealed surface and a light receptor aligned with the aperture of the cover, wherein the sealed photocell is positioned within the cover such that the sealed surface is biased toward the mounting surface; and an O-ring between the mounting surface and the sealed surface, wherein the O-ring contacts the sealed surface of the sealed photocell.

2. The light fixture of claim 1, wherein the O-ring is compressed between the sealed surface of the sealed photocell and the mounting surface of the fixture housing to seal the wire access hole from an environment surrounding the fixture housing.

3. The light fixture of claim 1, wherein:

the cover comprises a mounting flange; and the sealed photocell comprises a flange that abuts the mounting flange of the cover.

4. The light fixture of claim 1, wherein a plurality of fasteners are received through a plurality of holes of the mounting surface of the fixture housing to bias the sealed photocell toward the mounting surface.

5. The light fixture of claim 1, wherein the light receptor is open to an environment surrounding the light fixture.

6. The light fixture of claim 1, wherein the sealed photocell is external to the main cavity.

7. The light fixture of claim 1, wherein the mounting surface is generally flat.

8. The light fixture of claim 1, the fixture housing further comprising a plug that is porous and water repellent and a port.

9. The light fixture of claim 8, wherein the port is in communication with the main cavity.

10. The light fixture of claim 9, further comprising another cover that covers the port and is displaced from the plug, the another cover comprising at least one hole for passing air to the plug.

11. The light fixture of claim 1, wherein the aperture is located on an upper surface of the cover and the light receptor is disposed on an upper surface of the sealed photocell such that the light receptor receives light that passes through the aperture.

12. A light fixture housing comprising:

an interior cavity;

an exterior comprising a mounting surface with an access hole that is in communication with the interior cavity;

a cover comprising a mounting flange at a lower surface of the cover, wherein the mounting flange is coupled with the mounting surface, the cover further comprising an aperture on an upper surface of the cover such that the aperture is open to an environment surrounding the light fixture housing; and a photocell comprising a sealing surface and a light receptor, wherein the photocell is enclosed within the cover and oriented so that the light receptor aligns with the aperture of the cover to open to the environment;

wherein the photocell is external to the interior cavity and the sealing surface of the photocell seals the access hole from the environment surrounding the light fixture housing.

13. The light fixture housing of claim 12, further comprising an O-ring located between and contacting the mounting surface of the exterior of the light fixture housing and the sealing surface of the photocell that helps seal the access hole from the environment.

14. The light fixture housing of claim 12, wherein the photocell comprises a flange that abuts the mounting flange of the cover.

15. The light fixture housing of claim 12, wherein a plurality of fasteners are received through a plurality of holes of the mounting surface to bias the photocell toward the mounting surface.

16. The light fixture housing of claim 12, wherein the mounting surface is generally flat.

17. The light fixture housing of claim 12, wherein the sealing surface of the photocell is biased toward the mounting surface.

18. The light fixture housing of claim 12, further comprising a plug that is porous and water repellent and a port.

19. The light fixture housing of claim 18, wherein the port is in communication with the interior cavity.

20. The light fixture housing of claim 19, further comprising another cover that covers the port and is displaced from the plug, the another cover comprising at least one hole for allowing air to pass to the plug.

* * * * *